US010342301B1

(12) United States Patent
Terry

(10) Patent No.: US 10,342,301 B1
(45) Date of Patent: Jul. 9, 2019

(54) ALL OCCASIONS CELEBRATION MONEY PIN

(71) Applicant: Cassandra J Terry, Fayetteville, NC (US)

(72) Inventor: Cassandra J Terry, Fayetteville, NC (US)

( * ) Notice: Subject to any disclaimer, the term of this patent is extended or adjusted under 35 U.S.C. 154(b) by 135 days.

(21) Appl. No.: 15/404,933

(22) Filed: Jan. 12, 2017

(51) Int. Cl.

| | |
|---|---|
| ***A44C 1/00*** | (2006.01) |
| ***A45F 5/02*** | (2006.01) |
| ***A44B 9/16*** | (2006.01) |
| ***A45C 1/06*** | (2006.01) |

(52) U.S. Cl.
CPC ..... *A44C 1/00* (2013.01); *A44B 9/16* (2013.01); *A45C 1/06* (2013.01); *A45F 5/02* (2013.01); *A45C 2001/062* (2013.01)

(58) Field of Classification Search
CPC ..... A44C 1/00; A44B 9/16; A45C 2001/062; A45F 5/02; A45F 2200/055
See application file for complete search history.

(56) References Cited

U.S. PATENT DOCUMENTS 809,691 A * 1/1906 Jacoby ..... A41F 15/02 24/353
866,379 A * 9/1907 Monroe ..... G09F 3/14 24/710.1
2,013,952 A * 9/1935 George ..... A44B 9/14 24/353
3,220,452 A 11/1965 Mintzes
3,281,908 A * 11/1966 Ross ..... A44B 9/14 223/93
3,623,193 A * 11/1971 Rickard ..... A44C 1/00 24/545
4,903,379 A * 2/1990 Uchtman ..... A44C 3/001 24/351
5,553,363 A * 9/1996 Chen ..... A44B 9/14 24/353
6,082,422 A 7/2000 Kaminski
7,523,575 B1 * 4/2009 Nettles ..... G09F 1/10 24/13
7,587,844 B1 * 9/2009 Palmer ..... G09F 21/02 24/3.11
8,176,600 B1 5/2012 Massey, III
2011/0302812 A1 * 12/2011 Henry ..... A44C 3/001 40/1.5
2014/0144956 A1 * 5/2014 Ingram ..... A45C 13/023 224/269

* cited by examiner

*Primary Examiner* — Christopher R Harmon
(74) *Attorney, Agent, or Firm* — Peter A. Hurley; Richard L. Miller

(57) ABSTRACT

A novelty money-holding device that replaceably attaches to a garment of a user and releasably holds paper money so as to allow the paper money to be releasably attached to the garment of the user. The novelty money-holding device includes a safety pin, a plurality of binder clips, and an apparatus that attaches the plurality of binder clips to the safety pin. The safety pin replaceably attaches to the garment of the user. The plurality of binder clips are attached to the safety pin and releasably hold the paper money so as to allow the paper money to be releasably attached to the garment of the user.

45 Claims, 15 Drawing Sheets

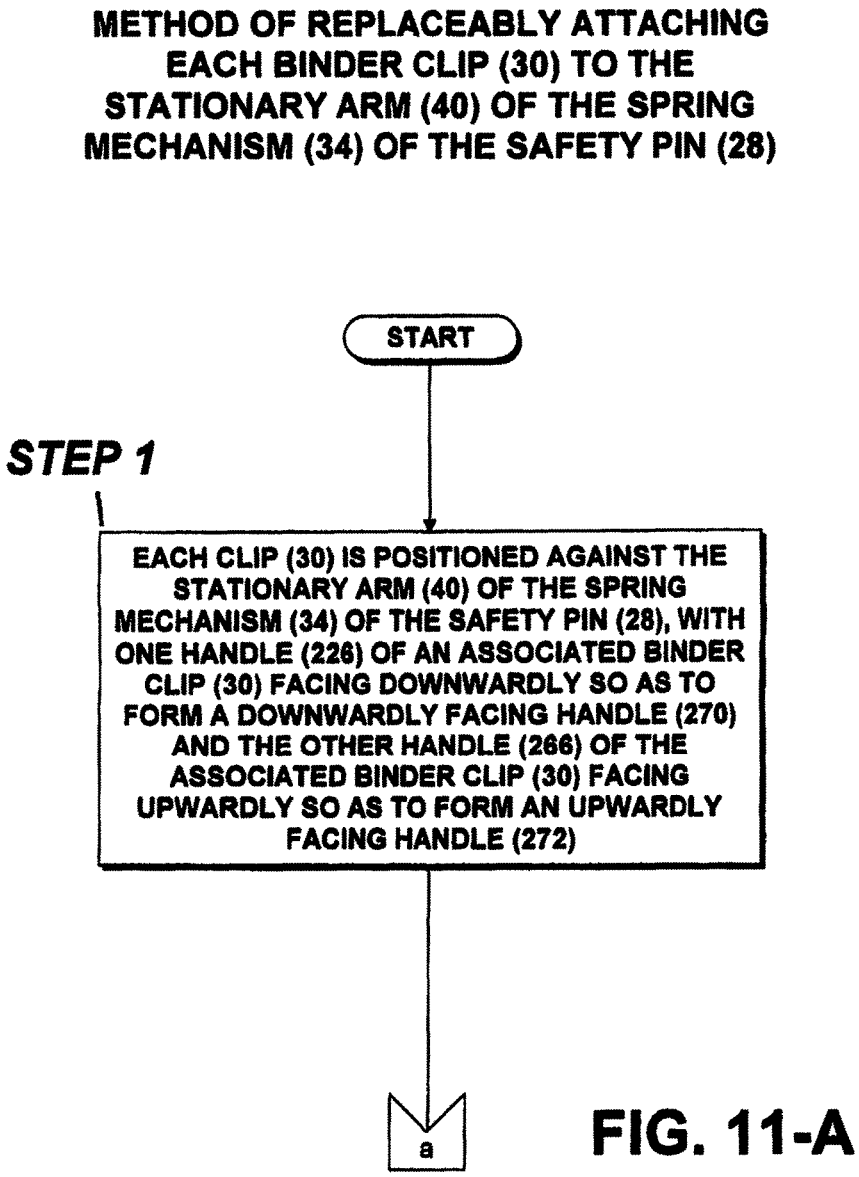
FIG. 11-A

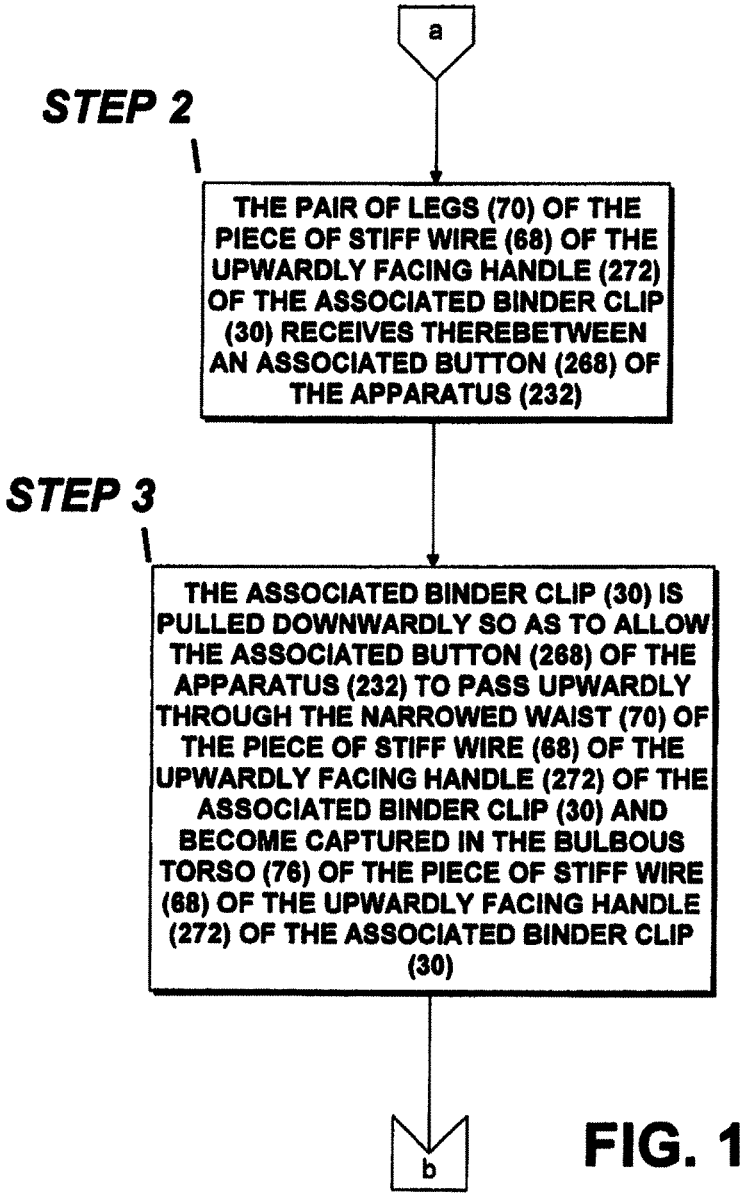
FIG. 11-B

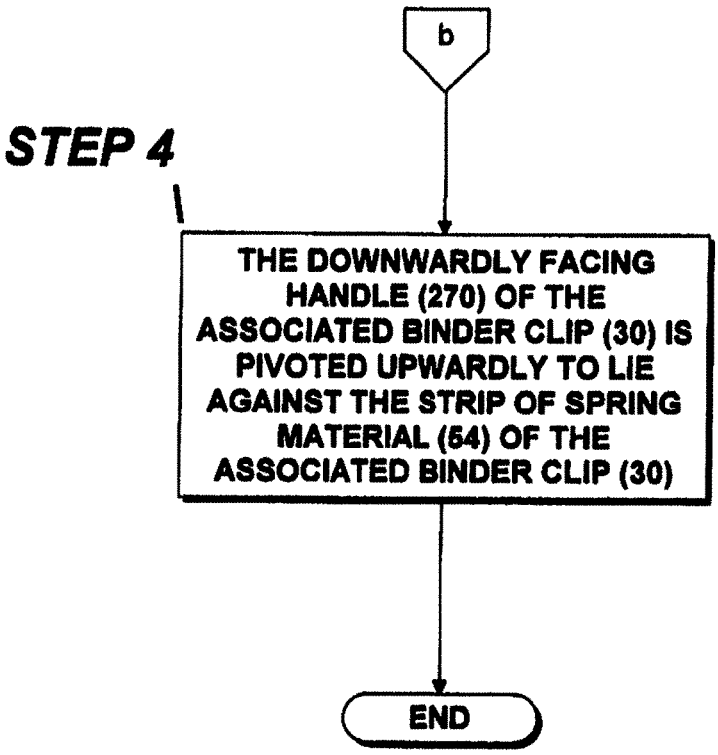
FIG. 11-C

ALL OCCASIONS CELEBRATION MONEY PIN

BACKGROUND OF THE INVENTION

Field of the Invention

The present invention relates to a money pin, and more particularly, an all occasions celebration money pin.

Description of the Prior Art

Numerous innovations for money holders have been provided in the prior art that will be described. Even though these innovations may be suitable for the specific individual purposes to which they address, however, they differ from the present invention.

A FIRST EXAMPLE, U.S. Pat. No. 3,220,452, Issued on Nov. 30, 1965, to Mintzes teaches a personal money container including an outer wall and an inner wall defining a pocket for paper money. The walls are foldable about a transverse line between their opposite ends. The inner wall has an end part free from direct securement to the outer wall to provide the pocket with an access opening. The outer wall has an opening therethrough in the vicinity of the end part of the inner wall. The container further includes apparatus for releasably holding paper money at the inner side of the pocket in position externally of the pocket and including a pair of retaining members secured in position at opposite sides, respectively, of the transverse line. One of the members is T-shaped and having a transverse part extending transversely of the inner wall and a longitudinal part extending from an intermediate portion of the transverse part to the secured end of the inner wall. The longitudinal part has side edges spaced from the side edges of the inner wall.

A SECOND EXAMPLE, U.S. Pat. No. 6,082,422, Issued on Jul. 4, 2000, to Kaminski teaches a combination money clip and card holder including a one-piece element having a rectangular base with two inwardly-oriented L-shaped brackets formed along longitudinal edges thereof. The rectangular base also contains a stop, formed on one of the transverse edges thereof. Together with the rectangular base, the L-shaped brackets include a channel for receiving flexible cards, such as, credit cards. The stop prevents the cards from being inserted too far into the channel. The edges of the base supporting the L-shaped brackets are tapered in the direction of the stop to provide a way for removably capturing the cards inserted into the channel. The holder also includes a resilient money clip formed on the opposite side of the base. The money clip is formed so that it is biased toward the base, thus allowing bank notes inserted between the clip and the base to be removably retained therein.

A THIRD EXAMPLE, U.S. Pat. No. 7,523,575, Issued on Apr. 28, 2009, to Nettles teaches a method and apparatus for attaching monetary gifts to the clothing being worn by a user. The method and apparatus teaches a badge-like portion having a celebratory greeting message disposed on the front side thereof and a clip on the rear side for attaching the badge in the lapel area of clothing being worn by the user. Also being attached to the rear surface of the badge is a wire attachment apparatus having a pair of ends. One end of the wire attachment apparatus can be threaded through the money so that the ends of the wire can then be reattached to the rear of the badge portion.

A FOURTH EXAMPLE, U.S. Pat. No. 8,176,600, Issued on May 15, 2012, to Massey, III teaches a money pin device that holds at least one of paper money and similar paper instruments on one's person for celebratory or suitable purposes. It also can be decoratively streamed lined and used as a simple filing system for posting at least one of receipts, notes, memos, and similar postings.

It is apparent now that numerous innovations for money holders have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an all occasions celebration money pin that avoids the disadvantages of the prior art.

ANOTHER OBJECT of the present invention is to provide an all occasions celebration money pin that is simple and inexpensive to manufacture.

STILL ANOTHER OBJECT of the present invention is to provide an all occasions celebration money pin that is simple to use.

BRIEFLY STATED, STILL YET ANOTHER OBJECT of the present invention is to provide a novelty money-holding device that replaceably attaches to a garment of a user and releasably holds paper money so as to allow the paper money to be releasably attached to the garment of the user. The novelty money-holding device includes a safety pin, a plurality of binder clips, and an apparatus that attaches the plurality of binder clips to the safety pin. The safety pin replaceably attaches to the garment of the user. The plurality of binder clips are attached to the safety pin and releasably hold the paper money so as to allow the paper money to be releasably attached to the garment of the user.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIGS. 11A-11C are a flowchart of the method of replaceably attaching each binder clip to the safety pin;

A MARSHALING OF REFERENCE NUMERALS UTILIZED IN THE DRAWING

Introductory

Figure 1:
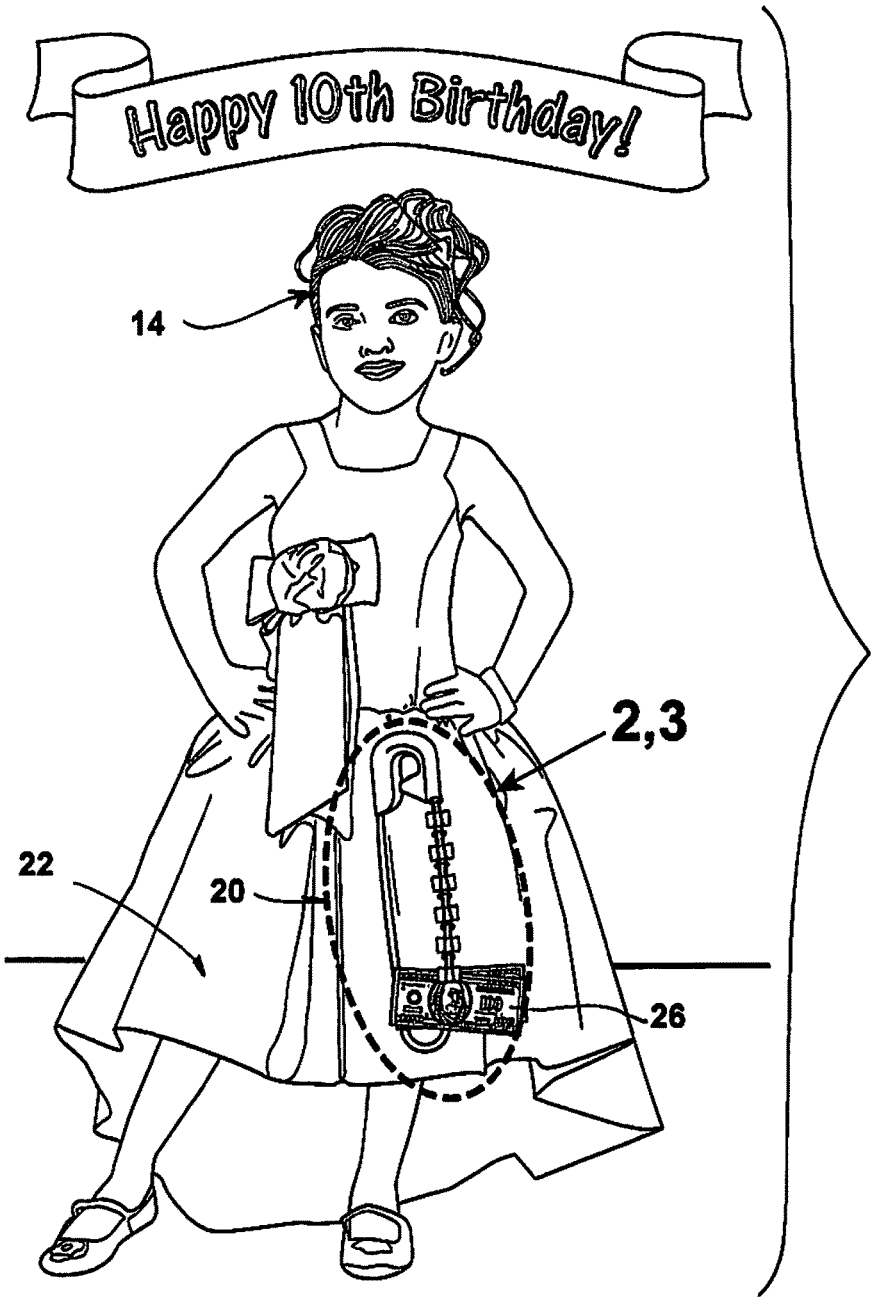
FIG. 1 is a diagrammatic perspective view illustrating a user wearing an embodiment of the money pin invention.
Figure 2:
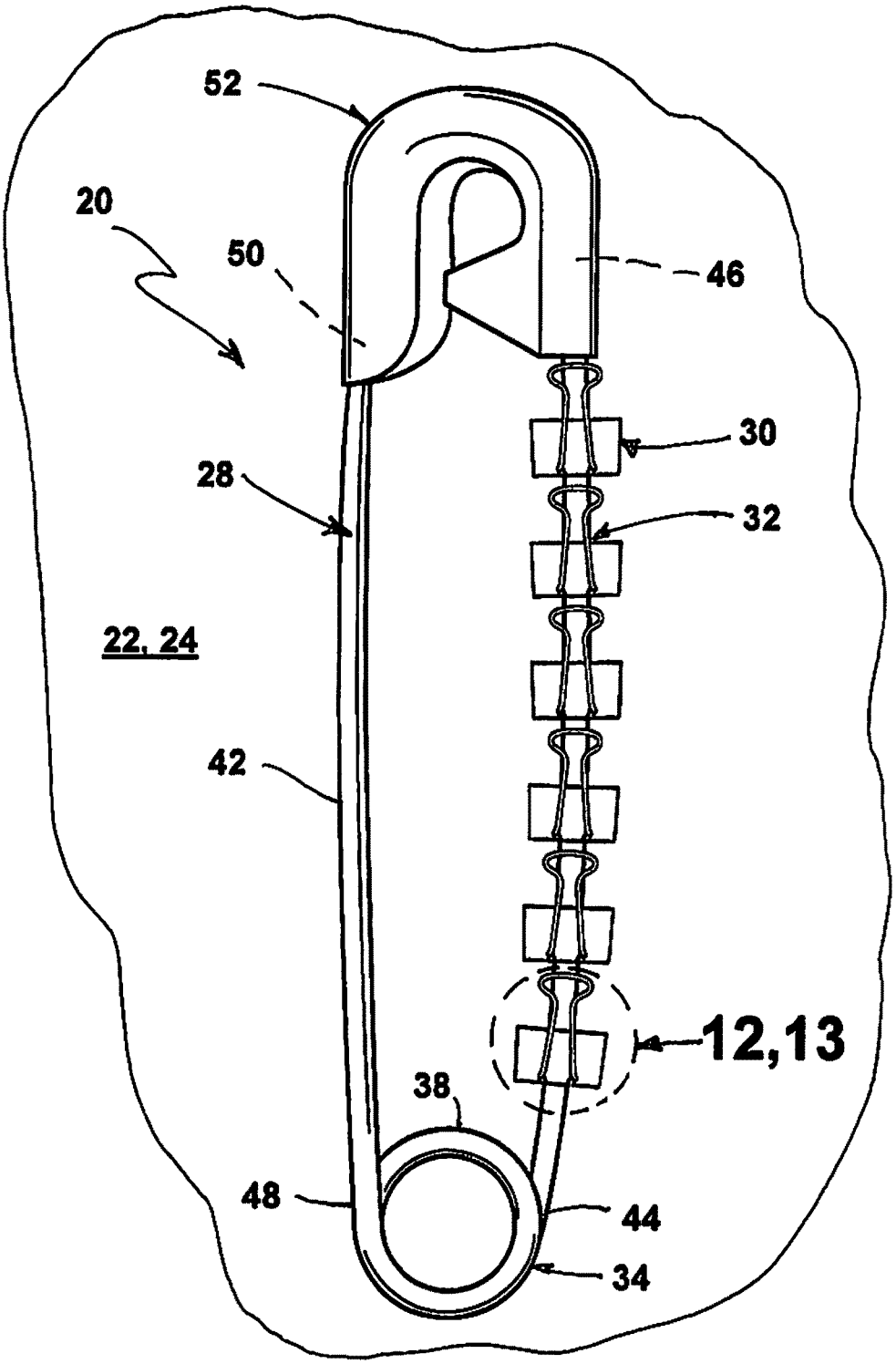
FIG. 2 is an enlarged, front elevational view of the area generally enclosed by the dotted curve identified by arrow 2 in FIG. 1, of a first embodiment thereof per se.
Figure 3:
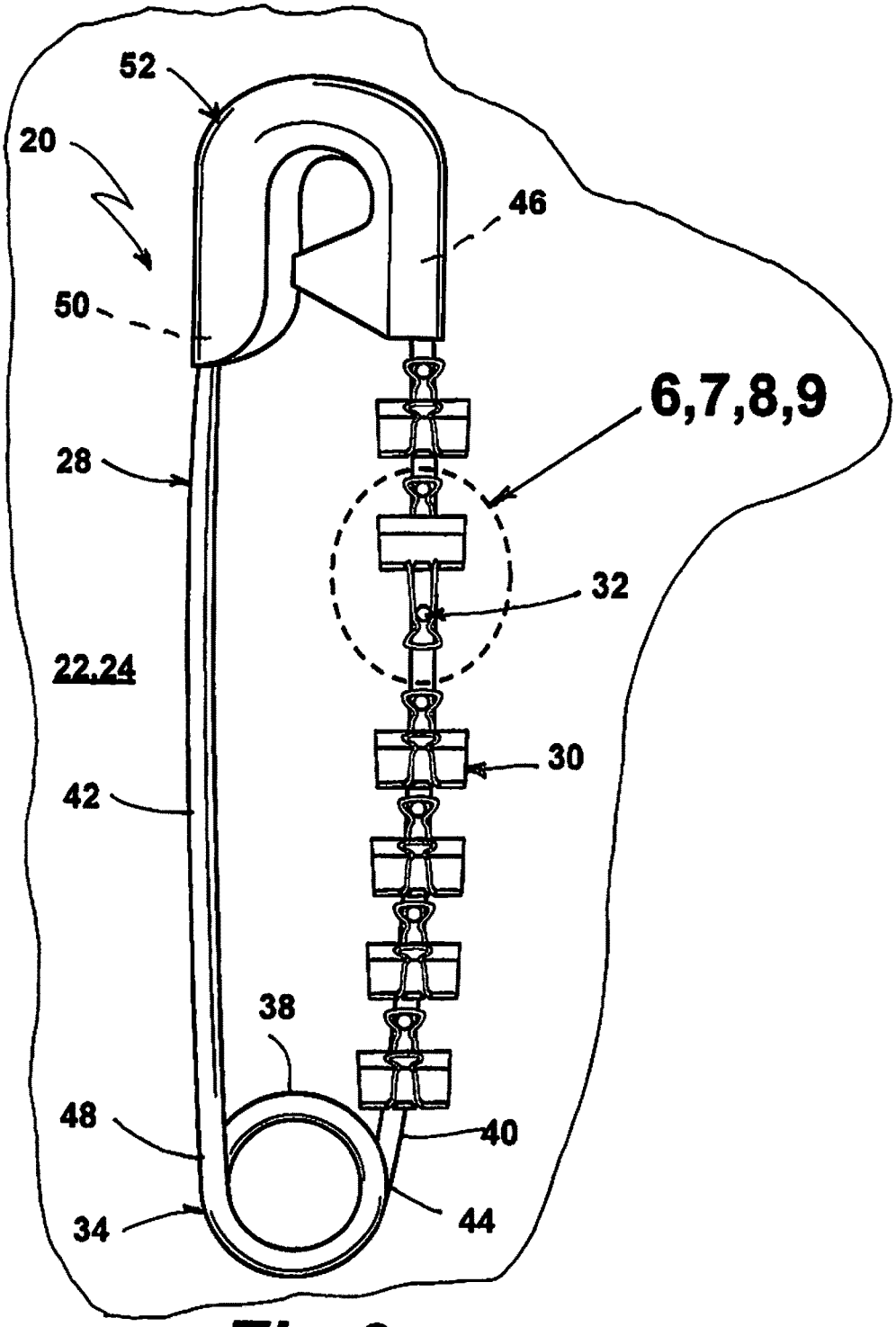
FIG. 3 is an enlarged, front elevational view of the area generally enclosed by the dotted curve identified by arrow 3 in FIG. 1, of a second embodiment thereof per se.
Figure 4:
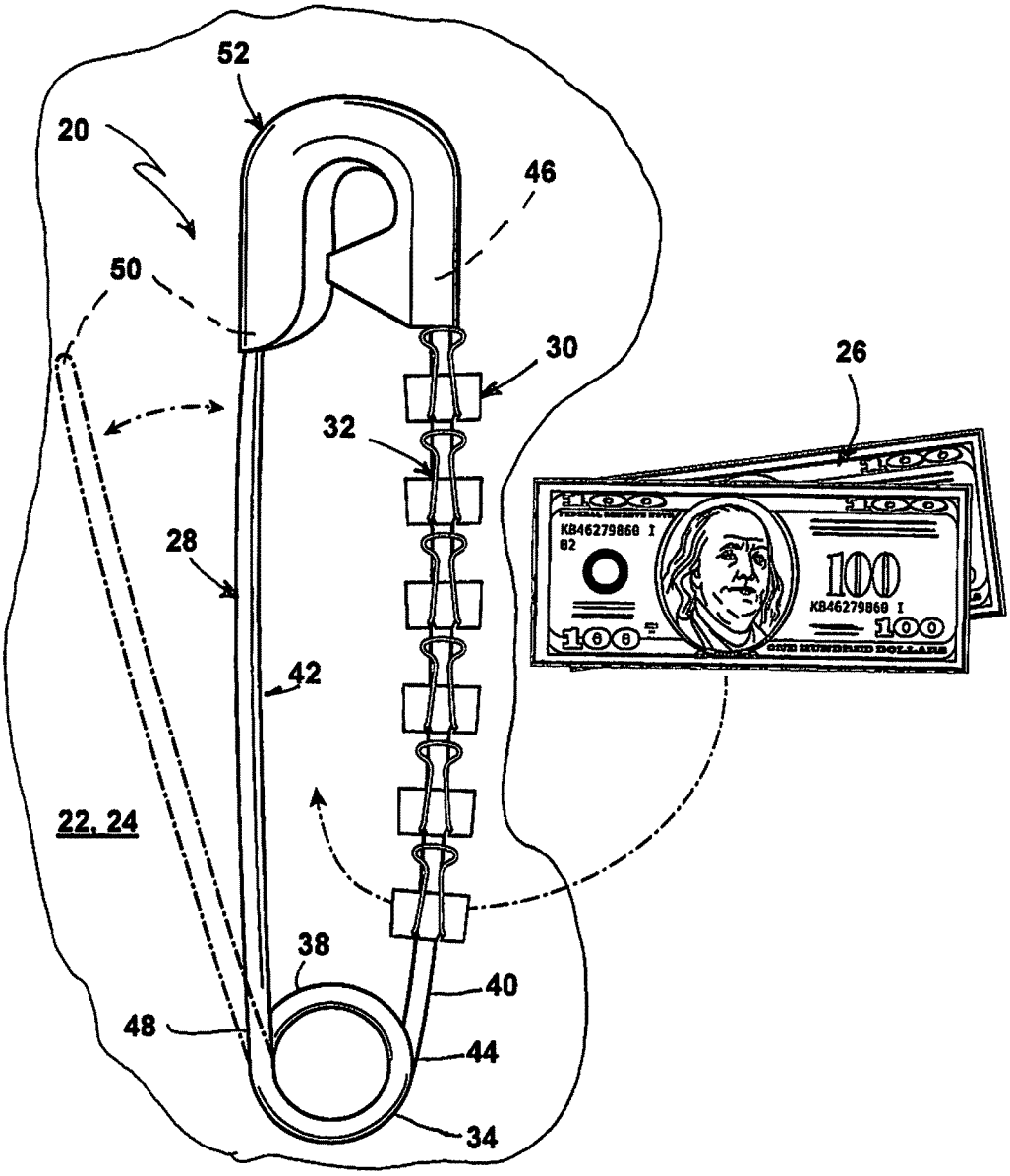
FIG. 4 is a diagrammatic front elevational view illustrating how money may be secured to the pin.
Figure 5:
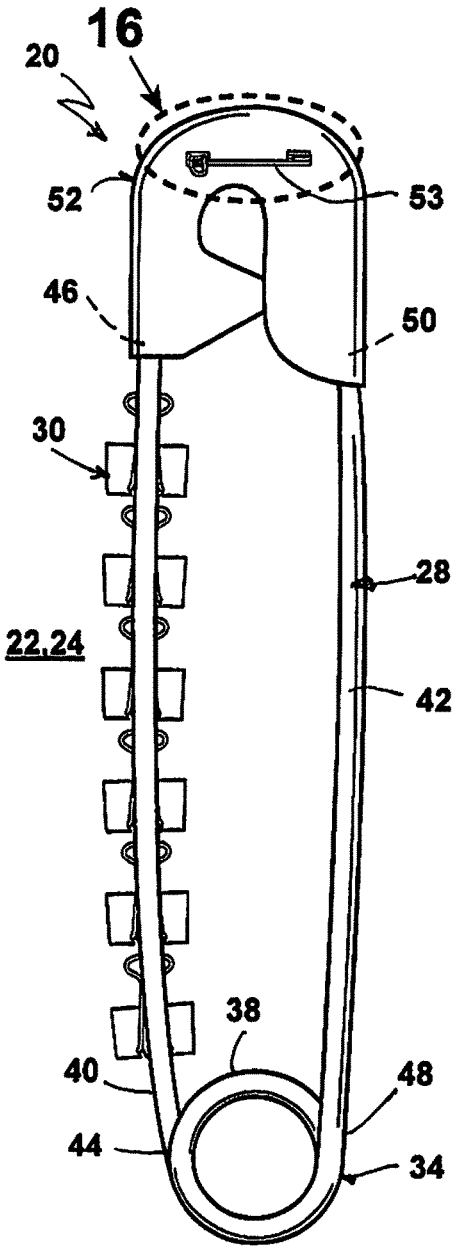
FIG. 5 is a diagrammatic rear elevational view of an embodiment thereof per se.

20 novelty money-holding device of embodiments of present invention for replaceably attaching to garment 22 of user 24 and for releasably holding paper money 26 so as to allow paper money 26 to be releasably attached to garment 22 of user 24

22 garment of user 24

24 user

26 paper money

Overall Configuration of Novelty Money-Holding Device 20

28 safety pin for replaceably attaching to garment 22 of user 24

30 plurality of binder clips for releasably holding paper money 26 so as to allow paper money 26 to be releasably attached to garment 22 of user 24

32 apparatus for attaching plurality of binder clips 30 to safety pin 28

Specific Configuration of Safety Pin 28

34 spring mechanism of safety pin 28

38 coil of spring mechanism 34 of safety pin 28

40 stationary arm of spring mechanism 34 of safety pin 28

42 movable arm of spring mechanism 34 of safety pin 28

44 one side of coil 38 of spring mechanism 34 of safety pin 28

46 terminal end of stationary arm 40 of spring mechanism 34 of safety pin 28

48 opposite side of coil 38 of spring mechanism 34 of safety pin 28

50 free and sharp terminal end of movable arm 42 of spring mechanism 34 of safety pin 28

52 clasp of safety pin 28

53 secondary pin of safety pin 28 for affixing novelty money-holding device to garment of user

Specific Configuration of Each Binder Clip of Plurality of Binder Clips 30

54 strip of spring material of each binder clip of plurality of binder clips 30

56 apex of strip of spring material 54 of each binder clip of plurality of binder clips 30

58 base of strip of spring material 54 of each binder clip of plurality of binder clips 30

60 pair of sides of strip of spring material 54 of each binder clip of plurality of binder clips 30

62 sharp edges of pair of sides 60 of strip of spring material 54 of each binder clip of plurality of binder clips 30, respectively

64 tubes of sharp edges 62 of pair of sides 60 of strip of spring material 54 of each binder clip of plurality of binder clips 30, respectively, for preventing sharp edges 62 of strip of spring material 54 of each binder clip of plurality of binder clips 30 from cutting into paper money 26

66 at least one handle of each binder clip of plurality of binder clips 30

68 piece of stiff wire of at least one handle 66 of each binder clip of plurality of binder clips 30

Configuration of Piece of Stiff Wire 68 of at Least One Handle 66 of Each Binder Clip of Plurality of Binder Clips 30

70 pair of legs of piece of stiff wire 68 of at least one handle 66 of each binder clip of plurality of binder clips 30

72 pair of feet of piece of stiff wire 68 of at least one handle 66 of each binder clip of plurality of binder clips 30

74 narrowed waist of piece of stiff wire 68 of at least one handle 66 of each binder clip of plurality of binder clips 30

76 bulbous torso of piece of stiff wire 68 of at least one handle 66 of each binder clip of plurality of binder clips 30

Specific Configuration of First Embodiment of Apparatus 132

132 apparatus

166 single handle of apparatus 132

Specific Configuration of Second Embodiment of Apparatus 232

266 pair of handles of apparatus 232

268 plurality of buttons of apparatus 232

Method of Replaceably Attaching Each Binder Clip of Plurality of Binder Clips 30 to Stationary Arm 40 of Spring Mechanism 34 of Safety Pin 28

270 downwardly facing handle of each binder clip 30
272 upwardly facing handle of each binder clip 30

Configuration of Alternate Embodiment of Novelty Money-Holding Device 300

300 novelty money-holding device
328 specifically configured substrate

DETAILED DESCRIPTION OF THE PREFERRED EMBODIMENTS

Introductory

Referring now to the figures, in which like numerals indicate like parts, and particularly to FIG. 1, the novelty money-holding device of the embodiments of the present invention is shown generally at 20 for replaceably attaching to a garment 22 of a user 24, and for releasably holding paper money 26 so as to allow the paper money 26 to be releasably attached to the garment 22 of the user 24.

Overall Configuration of the Novelty Money-Holding Device 20

The overall configuration of the novelty money-holding device 20 can best be seen in FIGS. 2-5, and as such, will be discussed with reference thereto.

The novelty money-holding device 20 comprises a safety pin 28, a plurality of binder clips 30, and an apparatus for attaching the plurality of binder clips 30 to the safety pin 28. The safety pin 28 is for replaceably attaching to the garment 22 of the user 24. The plurality of binder clips 30 are attached to the safety pin, and are for releasably holding paper money 26 so as to allow the paper money 26 to be releasably attached to the garment 22 of the user 24.

Specific Configuration of the Safety Pin 28

The specific configuration of the safety pin 28 can best be seen in FIGS. 1-5 and 16, and as such, will be discussed with reference thereto.

The safety pin 28 includes a spring mechanism 34.

The spring mechanism 34 of the safety pin 28 has a coil 38, a stationary arm 40, and a movable arm 42.

The stationary arm 40 of the spring mechanism 34 of the safety pin 28 extends from one side 44 of the coil 38 of the spring mechanism 34 of the safety pin 28 to a terminal end 46, while the movable arm 42 of the spring mechanism 34 of the safety pin 28 extends from an opposite side 48 of the coil 38 of the spring mechanism 34 of the safety pin 28 to a free and sharp terminal end 50.

The safety pin 28 further includes a clasp 52.

The clasp 52 of the safety pin 28 is affixed to the terminal end 46 of the stationary arm 40 of the spring mechanism 34 of the safety pin 28, and replaceably captures the free and sharp terminal end 50 of the movable arm 42 of the spring mechanism 34 of the safety pin 28.

When the free and sharp terminal end 50 of the movable arm 42 of the spring mechanism 34 of the safety pin 28 is captured in the clasp 52 of the safety pin 28, the clasp 52 of the safety pin 28 forms a closed loop for fastening the safety pin 28 to the garment 22 of the user 24.

And, when the free and sharp terminal end 50 of the movable arm 42 of the spring mechanism 34 of the safety pin 28 is captured in the clasp 52 of the safety pin 28, the clasp 52 of the safety pin 28 covers the free and sharp terminal end 50 of the movable arm 42 of the spring mechanism 34 of the safety pin 28 for protecting the user 24 from the free and sharp terminal end 50 of the movable arm 42 of the spring mechanism 34 of the safety pin 28 after the safety pin 28 has been affixed to the garment 22 of the user 24.

When the movable arm 42 of the spring mechanism 34 of the safety pin 28 is not being used to affix the novelty money-holding device to the garment 22 of the user 24, a secondary pin 53 is used.

The secondary pin 53 of the safety pin 28 is disposed on the clasp 52 of the safety pin 28.

Specific Configuration of Each Binder Clip 30

The specific configuration of each binder clip 30 can best be seen in FIGS. 6-15, and as such, will be discussed with reference thereto.

It is to be understood that the plurality of binder clips 30 can also be called either banker's clips or foldover clips.

Each binder clip 30 includes a strip of spring material 54.

The strip of spring material 54 of each binder clip 30 has a shape. The shape of the strip of spring material 54 of each binder clip 30 is of an isosceles triangle, and as such, has an apex 56, a base 58, and a pair of sides 60.

The pair of sides 60 of the strip of spring material 54 of each binder clip 30 have sharp edges 62 at the apex 56 of the strip of spring material 54 of an associated binder clip 30.

The sharp edges 62 of the pair of sides 60 of the strip of spring material 54 of each binder clip 30 have tubes 64, respectively, thereon. The tubes 64 of the sharp edges 62 of the pair of sides 60 of the strip of spring material 54 of each binder clip 30 are for preventing the sharp edges 62 of the pair of sides 60 of the strip of spring material 54 of an associated binder clip 30 from cutting into the paper money 26.

Tension along the base 58 of the strip of spring material 54 of each binder clip 30 forces the pair of sides 60 of the strip of spring material 54 of an associated binder clip 30 closed.

Each binder clip 30 further includes at least one handle 66.

The at least one handle 66 of each binder clip 30 is a piece of stiff wire 68.

The at least one handle 66 of each binder clip 30 is pivotally disposed within an associated tube 64 of an associated sharp edge 62 of an associated side 60 of the strip of spring material 54 of an associated binder clip 30, and as such, allows the associated binder clip 30 to be opened for receipt of the paper money 26, allows the at least one handle 66 of the associated binder clip 30 to be folded down upon the paper money 26 holding the associated binder clip 30 relatively flat for easy stacking of the paper money 26, and allows the at least one handle 66 of the associated binder clip 30 to be one of folded down and remained up for allowing the paper money 26 to be hung up.

The at least one handle 66 of each binder clip 30 is replaceably disposed within an associated tube 64 of an associated sharp edge 62 of an associated side 60 of the strip of spring material 54 of an associated binder clip 30 so as to allow the at least one handle 66 of each binder clip 30 to be removed by being squeezed sideways and pulled out from the associated tube 64 of the associated sharp edge 62 of the associated side 60 of the strip of spring material 54 of the associated binder clip 30.

Configuration of the Piece of Stiff Wire 68 of the at Least One Handle 66 of Each Binder Clip 30

Figure 15:
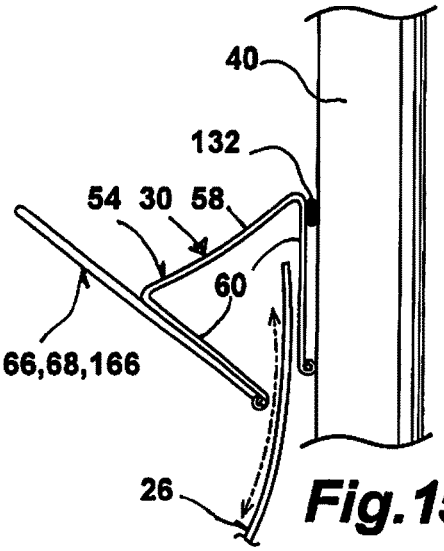
FIG. 15 is an enlarged diagrammatic side elevational view, taken in the direction of arrow 15 in FIG. 13 with money being secured therein.
Figure 15A:
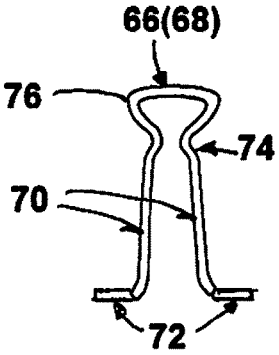
FIG. 15A is a diagrammatic view of an handle of a binder clip.
Figure 17:
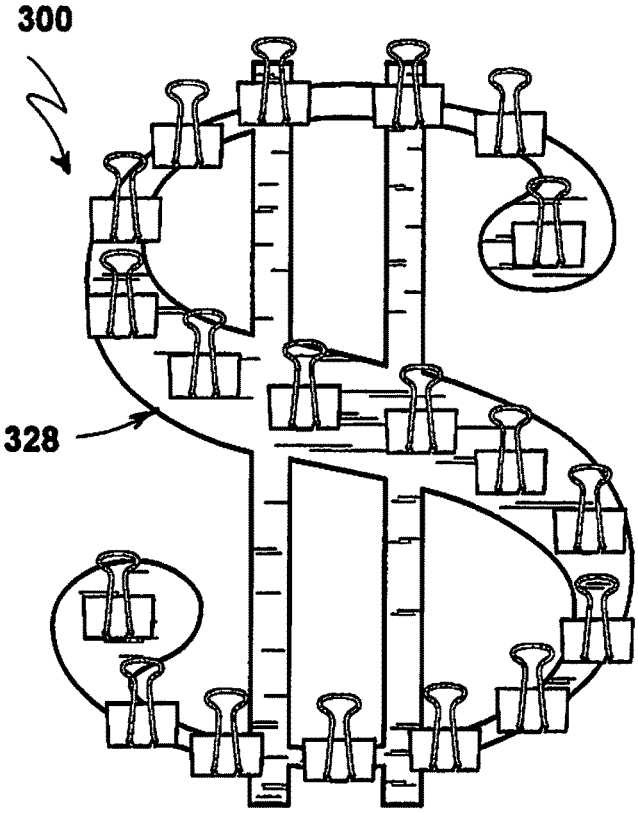
FIG. 17 is a front elevational view of a third embodiment of the money pin invention shaped in the ornamental pattern of a dollar sign illustrating with binder clips having fix securement mechanisms.
Figure 18:
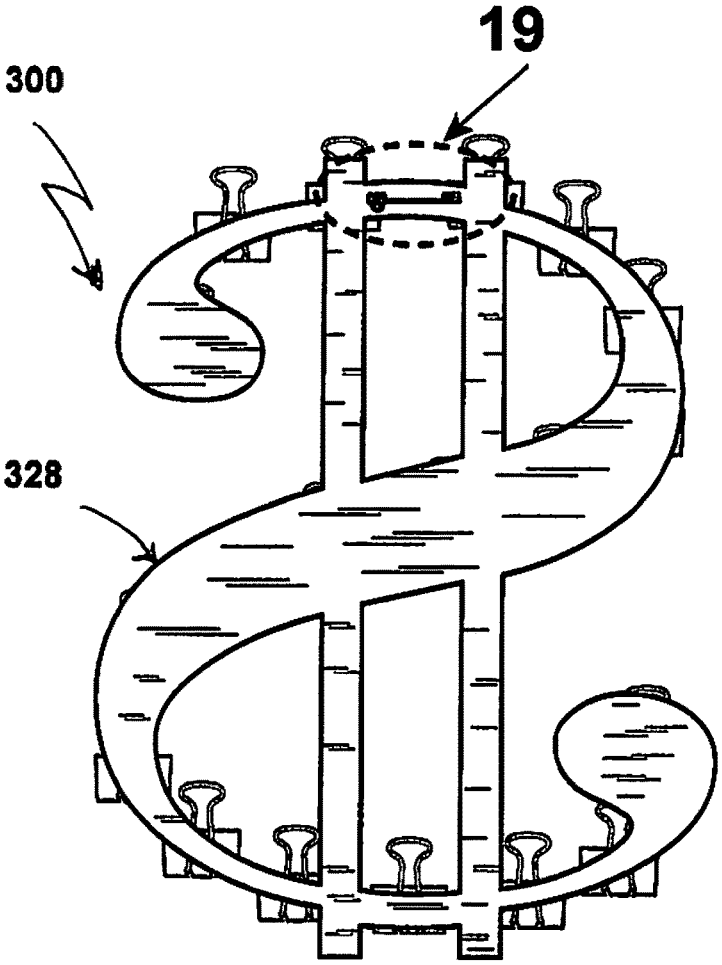
FIG. 18 is a rear elevational view thereof.
Figure 19:
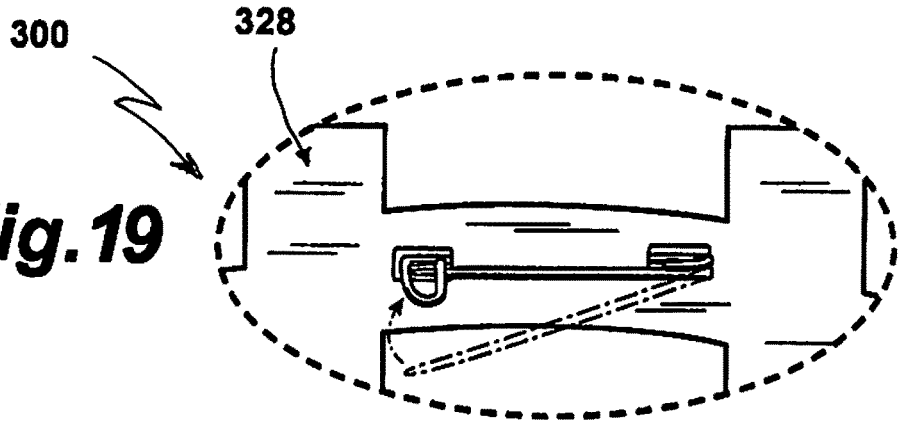
FIG. 19 is an enlarged view of the area inclosed in the dotted curve indicated by arrow 19 in FIG. 18 showing the pin for securing the money pin to a garment in greater detail.
Figure 20:
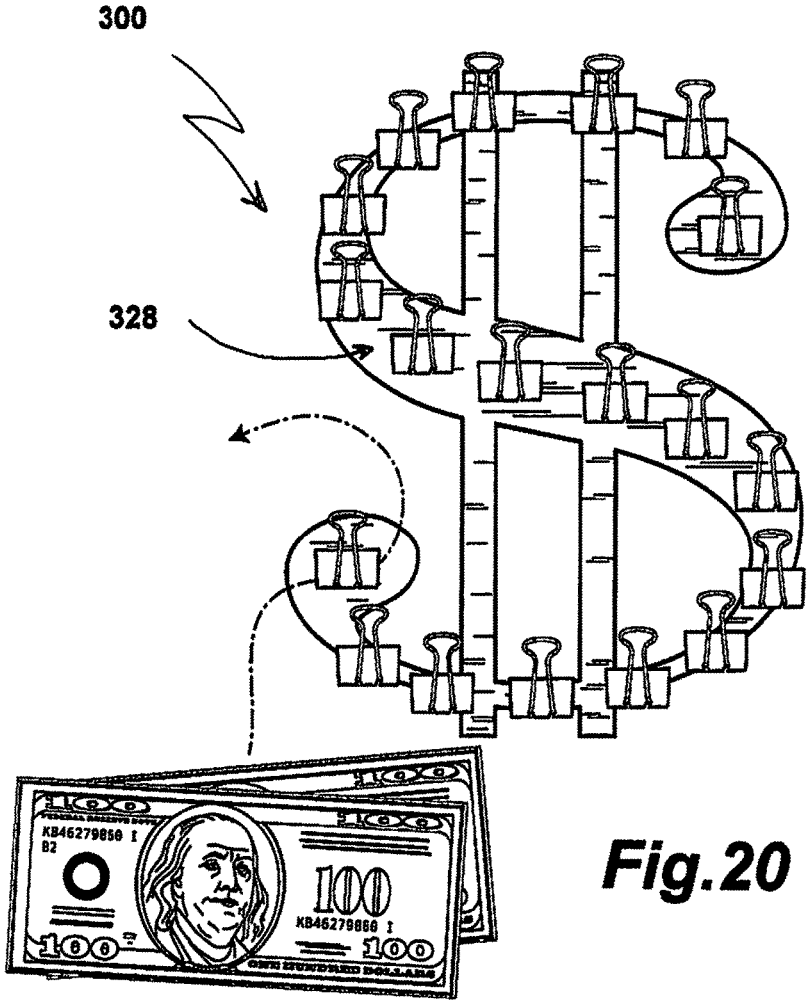
FIG. 20 is a front elevational view of the third embodiment of the money pin invention shaped in the ornamental pattern of a dollar sign illustrating with binder clips having fix securement mechanisms with money being secured therein.
Figure 21:
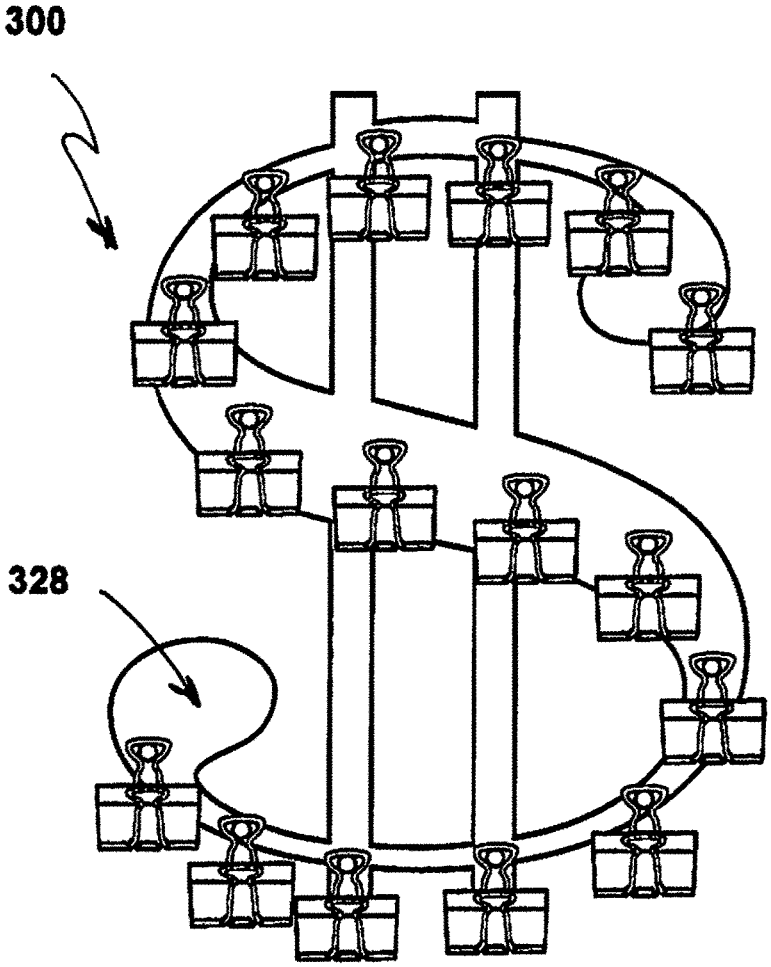
FIG. 21 is a front elevational view of a fourth embodiment of the money pin invention shaped in the ornamental pattern of a dollar sign illustrating with binder clips having removable securement mechanisms.
Figure 22:
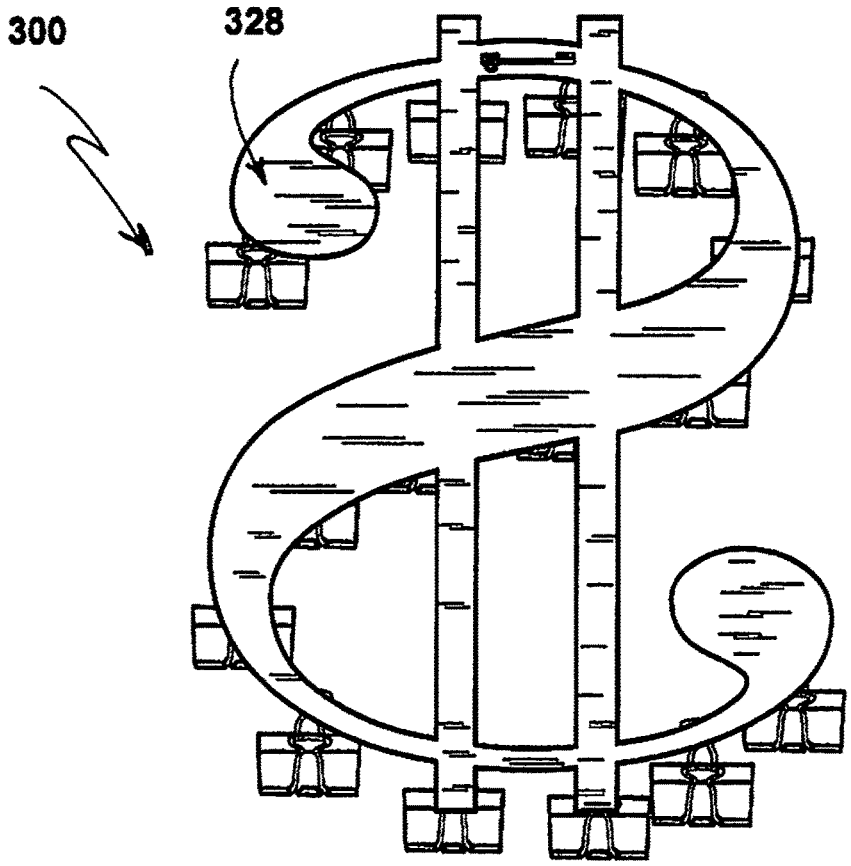
FIG. 22 is a rear elevational view thereof.

The configuration of the piece of stiff wire 68 of the at least one handle 66 of each binder clip 30 can best be seen in FIG. 15A, and as such, will be discussed with reference thereto.

The piece of stiff wire 68 of the at least one handle 66 has a pair of legs 70, a pair of feet 72, a narrowed waist 74, and a bulbous torso 76.

The narrowed waist of the piece of stiff wire 68 of the at least one handle 66 separates the bulbous torso 76 of the piece of stiff wire 68 of the at least one handle 66 from the pair of legs 70 of the piece of stiff wire 68 of the at least one handle 66.

The pair of feet 72 of the piece of stiff wire 68 of the at least one handle 66 extend opposingly outwardly from the pair of legs 70 of the piece of stiff wire 68 of the at least one handle 66, respectively, and are replaceably received within the pair of tubes 64 of the sharp edges 62 of the pair of sides of the strip of spring material 54 of an associated binder clip 30, respectively.

Specific Configuration of a First Embodiment of the Apparatus 132

The specific configuration of a first embodiment of the apparatus 132 can best be seen in FIGS. 12-15, and as such, will be discussed with reference thereto.

The apparatus 132 includes the at least one handle 66 of each binder clip 30 being a single handle 166.

The single handle 166 of the apparatus 132 is pivotally disposed within the tubes 64 of an associated sharp edge 62 of one side 60 of the strip of spring material 54 of an associated binder clip 30.

And, the other side 60 of the strip of spring material 54 of the associated binder clip 30 is affixed directly to the stationary arm 40 of the spring mechanism 34 of the safety pin 28 in such a position that the apex 56 of the strip of spring material 54 of the associated binder clip 30 faces downwardly for allowing the apex 56 of the strip of spring material 54 of the associated binder clip 30 to open and receive the paper money 26 when the single handle 166 of the apparatus 132 is pushed towards the stationary arm 40 of the spring mechanism 34 of the safety pin 28.

Specific Configuration of a Second Embodiment of the Apparatus 232

The specific configuration of a second embodiment of the apparatus 232 can best be seen in FIGS. 6-11, and as such, will be discussed with reference thereto.

The apparatus 232 includes the at least one handle 66 of each binder clip 30 being a pair of handles 266.

The pair of handles 266 of the apparatus 232 are pivotally disposed within the tubes 64 of the pair of sharp edges 62 of the pair of sides 60 of the strip of spring material 54 of each binder clip 30, respectively.

The apparatus 232 further includes a plurality of buttons 268.

The plurality of buttons 268 of the apparatus 232 are disposed spaced-apart along the stationary arm 40 of the spring mechanism 34 of the safety pin 28.

One handle 266 of each binder clip 30 replaceably receives an associated button 268 of said apparatus 232.

Method of Replaceably Attaching Each Binder Clip 30 to the Stationary Arm 40 of the Spring Mechanism 34 of the Safety Pin 28

The method of replaceably attaching each binder clip 30 to the stationary arm 40 of the spring mechanism 34 of the safety pin 28 can best be seen in FIGS. 6-11 and 11A-11C, and as such, will be discussed with reference thereto.

Figure 6:
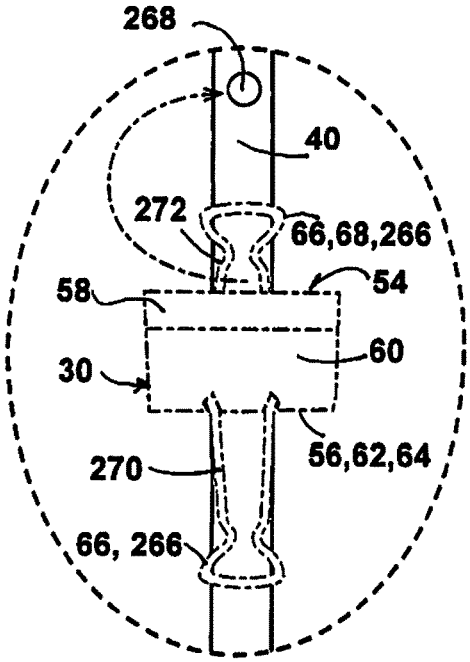
FIGS. 6,7,8, and 9 are enlarged diagrammatic views of the area inclosed in the dotted curve indicated by arrow 6,7,8, and 9, respectively, in FIG. 3 illustrating the binder clip with a removable securement mechanism with the binder clip shown in various states.
Figure 7:
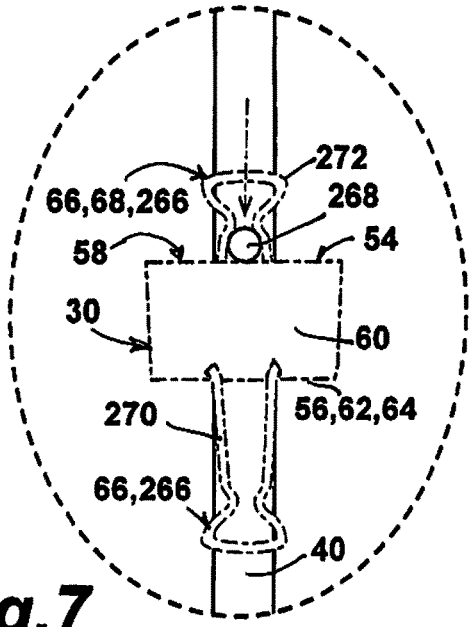
Figure 8:
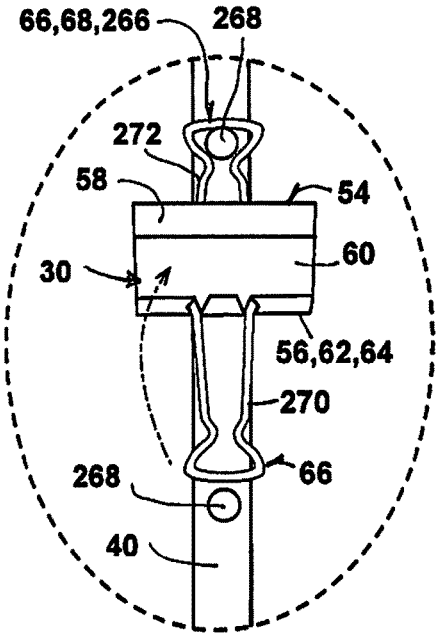
Figure 9:
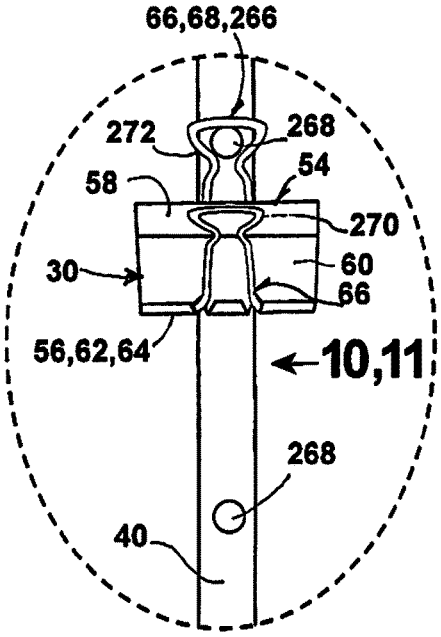
Figure 10:
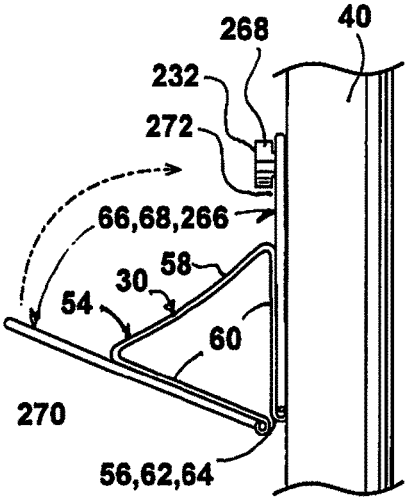
FIG. 10 is an enlarged diagrammatic side elevational view, taken in the direction of arrow 10 in FIG. 9 per se.
Figure 11:
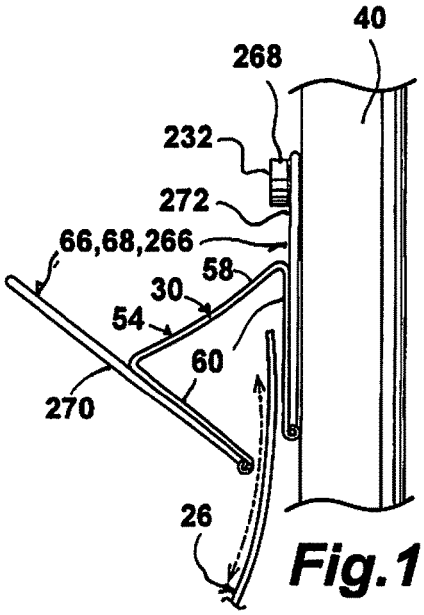
FIG. 11 is an enlarged diagrammatic side elevational view, taken in the direction of arrow 11 in FIG. 9 with money being secured therein.
Figure 12:
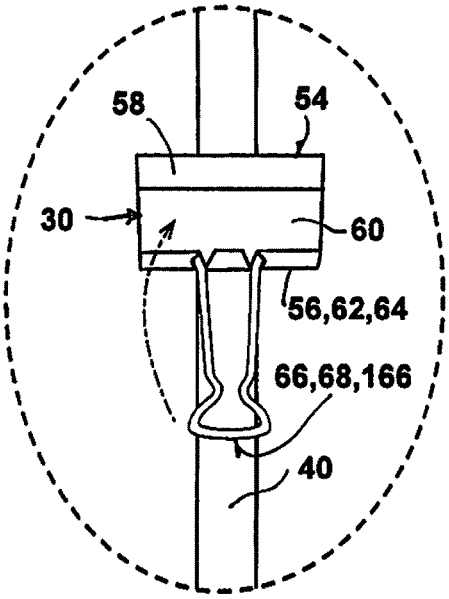
FIGS. 12 and 13 are enlarged diagrammatic views of the area inclosed in the dotted curve indicated by arrow 12 and 13, respectively, in FIG. 2 illustrating the binder clip with a fix securement mechanism with the binder clip shown in various states.
Figure 13:
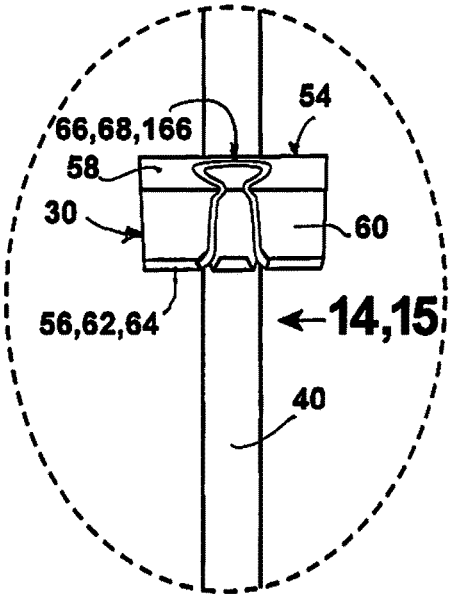
Figure 14:
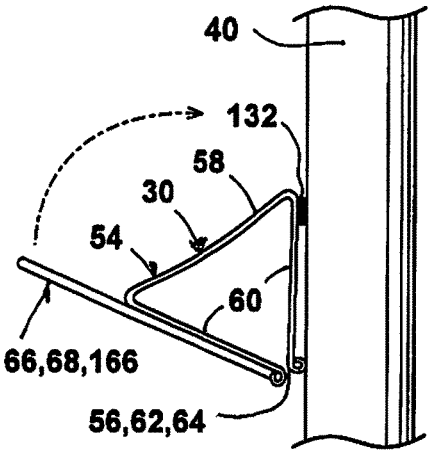
FIG. 14 is an enlarged diagrammatic side elevational view, taken in the direction of arrow 14 in FIG. 13 per se.
Figure 16:
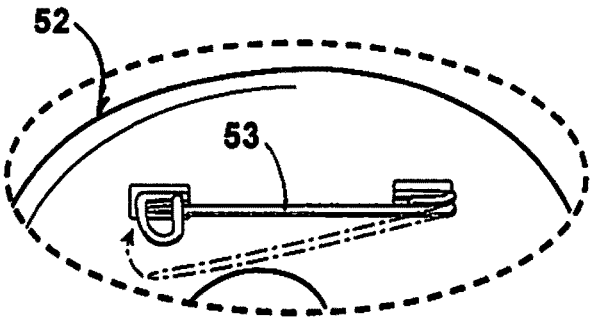
FIG. 16 is an enlarged rear view of the area generally enclosed by the dotted curve identified by arrow 16 in FIG. 5.

Step 1: As shown in FIGS. 6 and 11A, each clip 30 is positioned against the stationary arm 40 of the spring mechanism 34 of the safety pin 28, with one handle 226 of an associated binder clip 30 facing downwardly so as to form a downwardly facing handle 270 and the other handle 266 of the associated binder clip 30 facing upwardly so as to form an upwardly facing handle 272;

Step 2: As shown in FIGS. 7 and 11B, the pair of legs 70 of the piece of stiff wire 68 of the upwardly facing handle 272 of the associated binder clip 30 receive therebetween an associated button 268 of the apparatus 232;

Step 3: As shown in FIGS. 8, 10, and 11B, the associated binder clip 30 is pulled downwardly so as to allow the associated button 268 of the apparatus 232 to pass upwardly through the narrowed waist (70) of the piece of stiff wire 68 of the upwardly facing handle 272 of the associated binder clip 30 and become captured in the bulbous torso 76 of the piece of stiff wire 68 of the upwardly facing handle 272 of the associated binder clip 30; and Step 4: As shown in FIGS. 9, 11, and 11C the downwardly facing handle 270 of the associated binder clip 30 is pivoted upwardly to lie against the strip of spring material 54 of the associated binder clip 30.

Configuration of an Alternate Embodiment of the Novelty Money-Holding Device 300

The configuration of an alternate embodiment of the novelty money-holding device 300 can best be seen in FIGS. 17-22, and as such, will be discussed with reference thereto.

The novelty money-holding device 300 is similar to the novelty money-holding device 20, except that the safety pin 28 of the novelty money-holding device 20 is replaced by a specifically configured substrate 328.

The specifically configured substrate 328 of the novelty money-holding device 300 is a U.S. dollar sign. The U.S. dollar sign of the specifically configured substrate 328 is for alerting viewers that the paper money 26 must be U.S. paper money.

Impressions

It will be understood that each of the elements described above, or two or more together, may also find a useful application in other types of constructions differing from the types described above.

While the invention has been illustrated and described as embodiments of an all occasions celebration money pin, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A novelty money-holding device for replaceably attaching to a garment of a user and for releasably holding paper money so as to allow the paper money to be releasably attached to the garment of the user, comprising:

a) a safety pin;

b) a plurality of binder clips; and c) means for attaching said plurality of binder clips to said safety pin;

wherein said safety pin is for replaceably attaching to the garment of the user;

wherein said plurality of binder clips are attached to said safety pin; and wherein said plurality of binder clips are for releasably holding the paper money so as to allow the paper money to be releasably attached to the garment of the user.

2. The novelty money-holding device of claim 1, wherein said safety pin includes a spring mechanism.

3. The novelty money-holding device of claim 2, wherein said spring mechanism of said safety pin has a coil.

4. The novelty money-holding device of claim 3, wherein said spring mechanism of said safety pin has a stationary arm.

5. The novelty money-holding device of claim 4, wherein said spring mechanism of said safety pin has a movable arm.

6. The novelty money-holding device of claim 5, wherein said stationary arm of said spring mechanism of said safety pin extends from one side of said coil of said spring mechanism of said safety pin to a terminal end.

7. The novelty money-holding device of claim 6, wherein said movable arm of said spring mechanism of said safety pin extends from an opposite side of said coil of said spring mechanism of said safety pin to a free and sharp terminal end.

8. The novelty money-holding device of claim 7, wherein said safety pin includes a clasp.

9. The novelty money-holding device of claim 8, wherein said clasp of said safety pin is affixed to said terminal end of said stationary arm of said spring mechanism of said safety pin.

10. The novelty money-holding device of claim 8, wherein said clasp of said safety pin replaceably captures said free and sharp terminal end of said movable arm of said spring mechanism of said safety pin.

11. The novelty money-holding device of claim 8, wherein when said free and sharp terminal end of said movable arm of said spring mechanism of said safety pin is captured by said clasp of said safety pin, said clasp of said safety pin forms a closed loop; and wherein said closed loop is for fastening said safety pin to the garment of the user.

12. The novelty money-holding device of claim 8, wherein when said free and sharp terminal end of said movable arm of said spring mechanism of said safety pin is captured by said clasp of said safety pin, said clasp of said safety pin covers said free and sharp terminal end of said movable arm of said spring mechanism of said safety pin for protecting the user from said free and sharp terminal end of said movable arm of said spring mechanism of said safety pin after said safety pin has been affixed to the garment of the user.

13. The novelty money-holding device of claim 4, wherein each binder clip includes a strip of spring material.

14. The novelty money-holding device of claim 13, wherein said strip of spring material of each binder clip has a shape.

15. The novelty money-holding device of claim 14, wherein said shape of said strip of spring material of each binder clip is of an isosceles triangle.

16. The novelty money-holding device of claim 15, wherein said strip of spring material of each binder clip has an apex.

17. The novelty money-holding device of claim 16, wherein said strip of spring material of each binder clip has a base.

18. The novelty money-holding device of claim 17, wherein said strip of spring material of each binder clip has a pair of sides.

19. The novelty money-holding device of claim 18, wherein said pair of sides of said strip of spring material of each binder clip have sharp edges, respectively.

20. The novelty money-holding device of claim 18, wherein said pair of sides of said strip of spring material of each binder clip have sharp edges at said apex of said strip of spring material of each binder clip, respectively.

21. The novelty money-holding device of claim 19, wherein said sharp edges of said pair of sides of said strip of spring material of each binder clip have tubes thereon, respectively; and wherein said tubes of said sharp edges of said pair of sides of said strip of spring material of each binder clip are for preventing said sharp edges at said pair of sides of said strip of spring material of each binder clip from cutting into the paper money.

22. The novelty money-holding device of claim 18, wherein tension along said base of said strip of spring material of each binder clip forces said pair of sides of said strip of spring material of an associated binder clip closed.

23. The novelty money-holding device of claim 21, wherein each binder clip includes at least one handle.

24. The novelty money-holding device of claim 23, wherein said at least one handle of each binder clip is a piece of stiff wire.

25. The novelty money-holding device of claim 23, wherein said at least one handle of each binder clip is pivotally disposed within an associated tube of an associated sharp edge of an associated side of said strip of spring material of an associated binder clip.

26. The novelty money-holding device of claim 23, wherein said at least one handle of each binder clip allows an associated binder clip to be opened for receipt of the paper money.

27. The novelty money-holding device of claim 23, wherein said at least one handle of each binder clip allows said at least one handle of an associated binder clip to be folded down upon the paper money thereby holding said associated binder clip relatively flat for easy stacking of the paper money.

28. The novelty money-holding device of claim 23, wherein said at least one handle of each binder clip is replaceably disposed within an associated tube of an associated sharp edge of an associated side of said strip of spring material of an associated binder clip so as to allow said at least one handle of said associated binder clip to be removed by being squeezed sideways and pulled out from said associated tube of said associated sharp edge of said associated side of said strip of spring material of said associated binder clip.

29. The novelty money-holding device of claim 24, wherein said piece of stiff wire of said at least one handle has a pair of legs.

30. The novelty money-holding device of claim 29, wherein said piece of stiff wire of said at least one handle has a pair of feet.

31. The novelty money-holding device of claim 29, wherein said piece of stiff wire of said at least one handle has a narrowed waist.

32. The novelty money-holding device of claim 31, wherein said piece of stiff wire of said at least one handle has a bulbous torso.

33. The novelty money-holding device of claim 32, wherein said narrowed waist of said piece of stiff wire of said at least one handle separates said bulbous torso of said piece of stiff wire of said at least one handle from said pair of legs of said piece of stiff wire of said at least one handle.

34. The novelty money-holding device of claim 30, wherein said pair of feet of said piece of stiff wire of said at least one handle extend from said pair of legs of said piece of stiff wire of said at least one handle, respectively.

35. The novelty money-holding device of claim 30, wherein said pair of feet of said piece of stiff wire of said at least one handle extend opposingly from said pair of legs of said piece of stiff wire of said at least one handle, respectively.

36. The novelty money-holding device of claim 30, wherein said pair of feet of said piece of stiff wire of said at least one handle extend outwardly from said pair of legs of said piece of stiff wire of said at least one handle, respectively.

37. The novelty money-holding device of claim 30, wherein said pair of feet of said piece of stiff wire of said at least one handle are replaceably received within said pair of tubes of said sharp edges of said pair of sides of said strip of spring material of an associated binder clip, respectively.

38. The novelty money-holding device of claim 8, wherein said safety pin includes a secondary pin; and wherein said secondary pin of said safety pin is for affixing said novelty money-holding device to the garment of the user.

39. The novelty money-holding device of claim 38, wherein said secondary pin of said safety pin is disposed on said clasp of said safety pin.

40. The novelty money-holding device of claim 23, wherein said means includes said at least one handle of each binder clip being a single handle.

41. The novelty money-holding device of claim 40, wherein said single handle of said means is pivotally disposed within said tube of an associated sharp edge of one side of said strip of spring material of an associated binder clip.

42. The novelty money-holding device of claim 41, wherein the other side of said strip of spring material of each binder clip is affixed directly to said stationary arm of said spring mechanism of said safety pin.

43. The novelty money-holding device of claim 42, wherein said other side of said strip of spring material of each binder clip is affixed directly to said stationary arm of said spring mechanism of said safety pin in such a position that said apex of said strip of spring material of an associated binder clip faces downwardly so as to allow said apex of said strip of spring material of said associated binder clip to open for receiving the paper money when said single handle of said means is pushed towards said stationary arm of said spring mechanism of said safety pin.

44. The novelty money-holding device of claim 4, wherein each binder clip is positioned against said stationary arm or said spring mechanism of said safety pin.

45. A method of utilizing an apparatus of a novelty money-holding device to replaceably attach a binder clip of the novelty money-holding device to a stationary arm of a spring mechanism of a safety pin of the novelty money-holding device, comprising the steps of:

a) positioning a binder clip against the stationary arm of the spring mechanism of the safety pin, with one handle of an associated binder clip facing downwardly so as to form a downwardly facing handle and the other handle of the associated binder clip facing upwardly so as to form an upwardly facing handle;

b) receiving between a pair of legs of a piece of stiff wire of the upwardly facing handle of the associated binder clip an associated button of the apparatus;

c) pulling downwardly the associated binder clip so as to allow the associated button of the apparatus to pass upwardly through a narrowed waist of the piece of stiff wire of the upwardly facing handle of the associated binder clip and become captured in a bulbous torso of the piece of stiff wire of the upwardly facing handle of the associated binder clip; and d) pivoting the downwardly facing handle of the associated binder clip upwardly to lie against a strip of spring material of the associated binder clip.

* * * * *